US005240465A

United States Patent [19]

Palacin

[11] Patent Number: 5,240,465

[45] Date of Patent: Aug. 31, 1993

[54] PROCESS FOR REACTIVE DYEING A CELLULOSE-CONTAINING TEXTILE MATERIAL WITH ANIONIC DYEING ASSISTANT AS LEVELLING AGENT

[75] Inventor: Francis Palacin, Riedisheim, France

[73] Assignee: Sandoz Ltd., Basle, Switzerland

[21] Appl. No.: 984,810

[22] Filed: Dec. 3, 1992

Related U.S. Application Data

[63] Continuation of Ser. No. 712,858, Jun. 10, 1991, abandoned.

[30] Foreign Application Priority Data

Jun. 9, 1990 [DE] Fed. Rep. of Germany ..... 4018557
Nov. 19, 1990 [DE] Fed. Rep. of Germany ..... 4036807

[51] Int. Cl.[5] ..... D06P 1/52; D06P 1/56; D06P 1/62; D06P 3/66

[52] U.S. Cl. ..... 8/543; 8/527; 8/557; 8/560; 8/589; 8/609; 8/630; 8/918; 252/8.6; 252/8.7

[58] Field of Search ..... 8/543, 560; 252/8.7

[56] References Cited

U.S. PATENT DOCUMENTS 3,498,736 3/1970 Freyermuth et al. ..... 8/490
3,691,204 9/1972 Baumann et al. ..... 549/460
4,386,037 5/1983 Baumann ..... 8/94.33
4,391,718 7/1983 Reitz et al. ..... 252/8.7
4,410,331 10/1983 Wurmli et al. ..... 8/589
4,415,333 11/1983 Schlafer et al. ..... 8/524
4,923,481 5/1990 Galli et al. ..... 8/589
4,976,743 12/1990 Ohba et al. ..... 8/543

FOREIGN PATENT DOCUMENTS 1396126 6/1975 United Kingdom .

*Primary Examiner*—A. Lionel Clingman
*Attorney, Agent, or Firm*—Robert S. Honor; Richard E. Vila; Thomas C. Doyle

[57] ABSTRACT

A process for applying a reactive dye to a cellulosic substrate comprising:

(a) adding one or more dyeing assistants selected from the condensation product of sulphonated diphenyl ethers, condensation product of sulphonated ditolyl ethers, condensation products of polydiphenylsulphones with formaldehyde and condensation products of polyditolyl sulphones with formaldehyde (and salts thereof) into an aqueous liquor, optionally together with a salt (hereinafter defined as Process Step a);

(b) introducing the substrate into the dyebath and adding one or more reactive dyes, (hereinafter defined as Process Step b) ; and (c) fixing the dyestuff onto the substrate (hereinafter defined as Process Step c).

39 Claims, No Drawings

PROCESS FOR REACTIVE DYEING A

More preferably dyeing assistants are selected from compounds of formula I

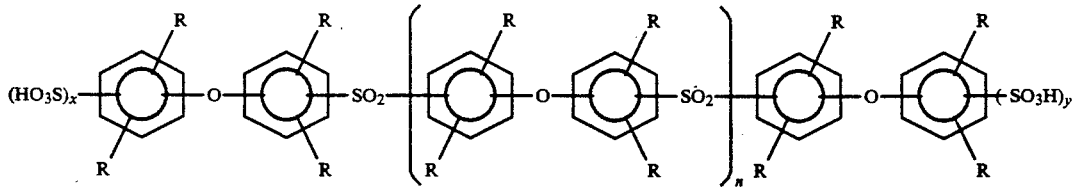

CELLULOSE-CONTAINING TEXTILE MATERIAL WITH ANIONIC DYEING ASSISTANT AS LEVELLING AGENT

This is a continuation of application Ser. No. 07/712,858, filed Jun. 10, 1991 and now abandoned.

The invention relates to a process for dyeing a cellulose containing textile material with reactive dyes, preferably by an exhaust process, to produce dyeings with excellent levelness.

Exhaust dyeing of cellulose textile material with reactive dyes is usually carried out in the presence of a certain amount of salt, preferably sodium chloride and/or sodium sulphate and alkali. The salt assists by causing the reactive dye to be taken up on the fiber (by adsorption) and the alkali assists in fixing the dye (by removing the resulting HCl).

The type of salt and alkali and their application has a significant effect on the levelness and reproducibility of the dyeings. The most critical factor is the amount of salt added to the bath prior to the addition of dye. Excess salt can cause dyeing to be too fast and this in turn can result in unlevelness in the dyeing.

Up until now, an optimal distribution of dyestuff has been achieved by adding specific doses of the salt. The particular difficulty here is that such a process requires addition of the salt to be in an aqueous form which, even when in a very highly concentrated form, causes dilution of the bath. The addition of salt in solid form is very time consuming.

It has now been found that a good dye distribution and level reproducible dyeings on cellulose fibrous substrates can be produced by a process according to the invention.

According to the invention there is provided a process for applying a reactive dye to a cellulosic substrate comprising:

(a) adding one or more dyeing assistants selected from condensation products of sulphonated diphenyl ethers, condensation products of sulphonated ditolyl ethers, condensation products of diphenyl sulphones with formaldehyde, condensation products of ditolyl sulphones with formaldehyde and salts thereof into an aqueous liquor, optionally together with a salt (hereinafter defined as Process Step a);

(b) introducing the substrate into the aqueous liquor and adding one or more reactive dyes, (hereinafter defined as Process Step b); and (c) fixing the dyestuff onto the substrate (hereinafter defined as Process Step c).

Preferred dyeing assistants for use in a process according to the invention are the condensation products of sulphonated diphenyl ethers (where the phenyl groups are unsubstituted or substituted by halo) or the condensation products of sulphonated tolyl ethers.

in free acid or salt form, in which x and y independently are 0 or 1 provided at least one of x and y is 1;

each R independently is selected from hydrogen, methyl and halogen, and n is 0 or an integer from 1 to 6 inclusive.

In a process according to the invention, the reactive dye can be added prior to the addition of the substrate or after the addition of substrate.

Preferably in a process according to the invention, the amount of dyeing assistant added is 0.05 to 5 g/l more preferably 0.2 to 2.5 g/l.

In this specification all g/l are based on the amount of liquor present.

Addition of the dyeing assistant may take place prior to, after or simultaneously with any addition of salt.

Preferably the process is an exhaust process.

Compounds of formula I are advantageously neutralized with ammonia, preferable before being added to the aqueous liquor. Preferably R is R' where R' is hydrogen or methyl.

Especially preferred dyeing assistants are selected from the compounds of U.S. Pat. No. 4,386,037 (=Swiss Patent 660,828 more preferably Example 1 of the Swiss Patent and the U.S. Patent). The contents of this U.S. Patent are incorporated herein by reference.

A preferred polydiphenyl sulphone is the condensation product of dihydroxydiphenyl sulphone, xylyl sulphonic acid and formaldehyde (a polydiphenyl sulphone).

Preferred salts used in Process step a) are selected from NaCl and Glauber salt. Preferably the amount of salt added is 1 to 200 g/l, more preferably 1-100 g/l most preferably 5-80 g/l.

Preferably in Process Step c) fixing is carried out by the addition of alkali after the substrate has been immersed in :he bath for at least 2 minutes to I hour, preferably 5-30 minutes.

Preferably the amount of alkali added is 0.1 to 50 g/l, more preferably 0.2 to 20 g/l.

Preferred alkalis for use in Process Step c) are sodium hydroxide, sodium carbonate, sodium silicate and sodium phosphate, more preferably sodium carbonate and sodium hydroxide.

Preferably, in a process according to the invention, an alkali metal tetraborate is preferably added prior to Process Step c). In this way irregularities in fixing due to the addition of alkali can be compensated for, thereby allowing level reproducible dyeing to be produced.

Preferably the amount of tetraborate added is 0.01 to 5 g/l, more preferably 0.1 to 2 g/l. Preferred alkali metal tetraborates are sodium or potassium tetraborate and their hydrates (such as borax or kernite). The tetraborate can be added at the same time as or after the addition of the dyeing assistant and before or after any salt present. It must, however, be added prior to fixing with alkali.

The liquor for use in a process according to the invention may also contain further assistants, such as dispersing agents, emulsifying agents and softeners.

Preferably in a process according to the invention the substrate to be dyed is added prior to reactive dye.

Further according to the invention there is provided an aqueous composition comprising a) 1 to 50% of a dyeing assistant selected from the condensation product of sulphonated diphenyl ethers, condensation products of sulphonated ditolyl ethers, condensation products of polydiphenylsulphones with formaldehyde and condensation products of polyditolyl sulphones with formaldehyde;

b) 1 to 50% of an alkali metal tetraborate;

c) 0 to 30% of a solubilizing agent, for example a hydrotropic agent; and d) up to 80% water.

Preferred compositions for use in a process according to the invention are selected from Compositions I to III below:

Composition I

I.

17.6% of a condensation product of sulphonated ditolyl ether, 30.0% of borax (sodium tetraborate.10 $H_2O$)

30.0% of glycerin and 22.4% of water;

Composition II

II.

22.0 parts of a condensation product of sulphonated ditolyl ether 24.0 parts of potassium tetraborate-tetrahydrate 10.0 parts of glycerin 1.5 parts of urea 2.5 parts of water; and Composition III

III.

40.0 parts of a condensation product of sulphonated ditolyl ether 4.0 parts of borax (sodium tetraborate.10 $H_2O$)

2.8 parts of urea 7.8 parts of ammonium sulphate 0.8 parts of polyacrylic acid (molecular weight ca. 5000)

0.8 parts of the sodium salt of diethylenetriaminopenta(methylenephosphonic acid) and 43.8 parts of water.

The compositions may preferably be used in an amount of 0.1 to 10 g/l, preferably 0.1 to 5 g/l.

Such a solution or composition according to the invention may contain a complexing agent. In Composition III, the sodium salt of diethylenetriaminopenta(-methylene phosphonic acid) and polyacrylic acid is a complexing agent. This is added to stop the precipitating out of any insoluble compound that may be present (for example $CaCO_3$) on the substrate. It also enables hard water to be used with hard water sensitive dyes.

The amount of solubilizing agent depends on the solubility of the tetraborate used, for instance borax is less soluble than potassium tetraborate so that when borax is used more solubilizing agent is added.

Preferred solubilizing agents (for example hydrotropic media) are selected from carbonyl compounds (such as urea, thiourea) alcohols, glycol ethers, esters and heterocyclic compounds. More preferred solubilizing agents are methanol, ethanol, butanol, glycerin, ethylene glycol, diethyene glycol, sorbite, glycerin acetate, monoethylglycolether, monobutylglycol ether, monoethyldiglycolether, monobutyldiglycol ether, butyrolactone and N-methylpyrrolidine.

Preferably in a process according to the invention the goods to liquor ratio is 1:1 to 1:100, more preferably 1:4 to 1:100, most preferably 1:4 to 1:30.

Preferred reactive dyes used in a process according to the invention are those of the azo, anthraquinone, metal complex or phthalocyanine series. More preferably the reactive dyes are selected from water soluble dyes that can be fixed at a pH of 8–12.5 at a temperature of 20°–100° C. (preferably by exhaustion). Most preferred reactive dyes are those containing at least one group selected from mono- and di-chlorotriazinyl, monofluorotriazinyl, mono- and difluoropyrimidine, fluorochloropyrimidine, dichloroquinoxaline, methylsulphonylchloro methyl pyrimidine and sulphatoethyl sulphonyl groups.

A composition according to the invention is preferably added to the liquor at the beginning of the dyeing process. Salt is then optionally added either prior to or preferably after (in solid form or as liquid concentrate) the addition of dye.

Preferably after dyeing, alkali is then added portion by portion. After alkali addition preferably the substrate is allowed to dwell in the bath for 5 to 60 minutes. The substrate is then rinsed and washed conventionally.

The substrate is preferably a natural or synthetic cellulosic containing substrate, which optionally can be mixed with other natural and/or synthetic fibers (for example polyester).

A process according to the invention is particularly suitable for dyeing yarn on a spool, (that generally has a tendency to unreproducability and unlevel dyeing).

A process according to the invention can be applied by conventional exhaust processes, for example on a yarn dyeing machine, a jigger or jet dyeing apparatus, typically at temperatures in the range 20–100, preferably 20°–80° C. A short dye bath or a long dye bath can be used.

All parts given are by weight.

The invention will now be illustrated by the following Examples.

EXAMPLE 1

0.5 parts of the condensation product of Example 1 of Swiss Patent 660 828 (a condensation product derived from sulphonated ditolyl ether)—referred hereinafter as Product A 0.6 parts borax and 100 parts of Glauber salt is added to an aqueous liquor (bath) of 1600 parts in a yarn dyeing machine. This is warmed to 40° C. and 100 parts of a cotton wool fabric is introduced.

A solution of 3.3 parts of C.I. Reactive Red 147 in 100 parts of water is added to the bath and dyeing is allowed to occur for 30 min. at 40° C. Then, at intervals of 5 minutes, 5×7 parts (each time) of a 2.5% of a NaOH solution is added and the dyeing is allowed to continue for a further 40 minutes at 40° C. After the washing, rinsing and drying, a level reproducible red dyeing results.

Table 1 below shows the degree of fixing of the dyeing of Example 1 compared with a similar dyeing in which Product A is absent.

TABLE 1

| Time (min.) | 0 | 5 | 10 | 15 | 20 | 30 | 60 |
|---|---|---|---|---|---|---|---|
| Degree of fixing without Product A. | 0 | 39 | 66 | 82 | 91 | 97 | 100 |
| Degree of fixing with Product A | 0 | 14 | 30 | 42 | 62 | 86 | 100 |

(0 mins means the time of first adding alkali).

EXAMPLE 2

Example 1 is repeated using, instead to the 3.3 parts of C.I. Reactive Red 147, 3.3 parts of C.I. Reactive Blue 209. A level and reproducible blue dyeing results.

Table 2 below shows the degree of fixing of the dyeing of Example 2 and a similar dyeing not having Product A.

TABLE 2

| Time (min.) | 0 | 5 | 10 | 15 | 20 | 30 | 60 |
|---|---|---|---|---|---|---|---|
| Degree of fixing without Product A | 0 | 37 | 64 | 79 | 92 | 99 | 100 |
| Degree of fixing with Product A | 0 | 13 | 25 | 38 | 56.5 | 84 | 100 |

EXAMPLE 3

2 parts of the following composition (Composition I):

17.6% of a condensation product to sulphonated ditolyl ether,
30.0% of borax (sodium tetraborate.$10H_2O$)
30.0% glycerin and
22.4% of water, together with 100 parts of Glauber salt is added to 1600 parts of an aqueous liquor heated to 40° C. To this liquor, 100 parts of a cotton fabric are introduced. 100 parts of an aqueous solution of 1.1 parts of C.I. Reactive Yellow 125 are added and dyeing is allowed to run for 30 minutes at 40° C. Then in intervals of 5 minutes each, 5×5 parts (each time) of a 2.5% aqueous NaOH solution is added and the dyeing is allowed to proceed for a further 40 minutes at 40° C. After washing, rinsing and drying, a very level reproducable yellow dyeing results.

Table 3 shows the degree of fixing of the dyeing of Example 3 compared with the same dyeing without composition I present.

TABLE 3

| Time (min.) | 0 | 5 | 10 | 15 | 20 | 30 | 60 |
|---|---|---|---|---|---|---|---|
| Degree of Fixing without Comp. I | 0 | 33 | 64 | 83.5 | 92.5 | 100 | 100 |
| Degree of Fixing with Comp. I | 0 | 14 | 21 | 37 | 54 | 91 | 100 |

Example 3 can be repeated using instead of Composition I, the same amount of Composition II or II defined above.

Composition II is:
22.0 parts of a condensation product of sulphonated ditolyl ether
24.0 parts of potassium tetraborate tetra hydrate
10.0 parts of glycerin
1.5 parts of urea
42.5 parts of water Composition III is:
40.0 parts of a condensation product of sulphonated ditolyl ether
4.0 parts of borax
2.8 parts of urea
7.8 parts of ammonia sulphate
0.8 parts of polyacrylic acid (molecular weight ca. 5000)
0.8 parts of diethylenetriaminepenta (methylenephosphonic acid)
43.8 parts of water Example 3 may also be repeated using 2 parts of polydiphenyl sulphone (that is commercially available as Nylonfixan P neutralized with ammonia) or a sulphonated diphenyl ether in place of Composition I, or using 17.6% of either of these products in place of the sulphonated ditolyl ether in Composition I.

EXAMPLE 4

2 parts of composition III defined above and 120 parts of Glauber salt are added to 1600 parts of an aqueous bath warmed to 60° C. 100 parts of a cotton fabric are then immersed into the bath. 100 parts of an aqueous solution of 3.1 parts of C.I. Reactive Blue 52 are then added and heated to 98° C. and dyeing is carried out at this temperature for 30 minutes.

Then, at 5 minute intervals, five additions of 6.4 parts each of a 5% aqueous NaOH solution is added and dyeing is continued after cooling to 40° C. for a further 40 minutes. After washing, rinsing and drying a level reproducible blue dyeing results.

The fixing grade of the resulting dyeing of Example 4 is shown in Table 4 below compared to that of a similar dyeing without composition III present.

TABLE 4

| Time (min.) | 0 | 5 | 10 | 15 | 20 | 30 | 60 |
|---|---|---|---|---|---|---|---|
| Degree of fixing without Comp. III | 0 | 25 | 49 | 65 | 80 | 94 | 100 |
| Degree of fixing with Composition III | 0 | 12.5 | 32 | 52 | 70 | 83 | 98 |

Examples 1 to 4 can be repeated using the same amount of any one of the other of Product A and Compositions I to III, in place of the dyeing assistant of the Example (the dyeing assistant in the case of Examples 1 and 2 being Product A , in Example 3 being Composition I and in Example 4 being Composition III).

What is claimed is:

1. A process for applying a reactive dye to a cellulosic substrate comprising the steps of:
(a) adding one or more dyeing assistants selected from condensation products of sulphonated diphenyl ethers, condensation products of sulphonated ditolyl ethers, condensation products of diphenyl sulphones with formaldehyde and condensation products of ditolyl sulphones with formaldehyde and salts thereof into an aqueous liquor;
(b) introducing the substrate and one or more reactive dyes into the aqueous liquor; and
(c) fixing the dyestuff onto the substrate.

2. A process according to claim 1 in which the dyeing assistant is selected from condensation products of sulphonated diphenyl ethers where the phenyl groups are unsubstituted or substituted by halo and condensation products of sulphonated ditolyl ethers.

3. A process according to claim 1 in which the dyeing assistant is selected from compounds of formula I

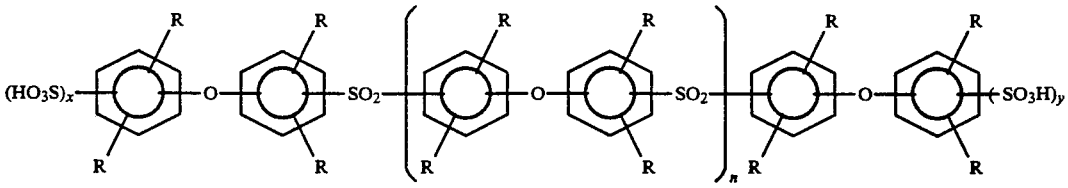

in free acid or salt form, in which x and y independently is 0 or 1 provided at least one of x and y is is 1;

each R independently is selected from hydrogen, methyl and halogen, and n is 0 or an integer from 1 to 6 inclusive.

4. A process according to claim 1 in which the reactive dye is added after the addition of substrate.

5. A process according to claim 1 in which the amount of dyeing assistant added is 0.05 to 5gram per liter of liquor.

6. A process according to claim 1 in which the amount of dyeing assistant added is 0.2 to 2.5 grams per liter of liquor.

7. A process according to claim 1 which is an exhaust process.

8. A process according to claim 3 in which the compounds of formula I are neutralized with ammonia.

9. A process according to claim 3 in which R is R' where R' is hydrogen or methyl.

10. A process according to claim 1 in which the dyeing assistant is the condensation product of dihydroxydiphenyl sulphone, xylyl sulphonic acid and formaldehyde.

11. A process according to claim 1 in which a salt is used in step a) selected from NaCl and Glauber salt.

12. A process according to claim 11 in which the amount of salt added is up to 100 g/l.

13. A process according to claim 1 in which in step c) fixing is carried out by the addition of alkali after the substrate has been immersed in the dye-containing aqueous liquor for at least 2 minutes.

14. A process according to claim 13 in which the alkali used in step c) is sodium hydroxide, sodium carbonate, sodium silicate or sodium phosphate.

15. A process according to claim in which an alkali metal tetraborate is added prior to step c).

16. A process according to claim 1 wherein the cellulosic substrate is cotton.

17. A process according to claim 1 in which any condensation product of sulphonated diphenyl ethers or of sulphonated ditolyl ethers as the dyeing assistant is selected from compounds of formula I n is 0 or an integer from 1 to 6 inclusive.

18. A process according to claim 3 in which , in step c), fixing is carried out by the addition of alkali after the substrate has been immersed in the dye-containing aqueous liquor for at least 2 minutes.

19. A process according to claim 18 in which an alkali metal tetraborate is added prior to step c).

20. A process according to claim 19 in which a salt selected from NaCl and Glauber salt is used in step a).

21. A process according to claim 20 which is an exhaust process.

22. A process according to claim 21 in which the amount of dyeing assistant added is 0.05 to 5 grams per liter of liquor.

23. A process according to claim 22 wherein the cellulosic substrate is cotton.

24. A process according to claim 3 in which the amount of dyeing assistant added is 0.05 to 5 grams per liter of liquor.

25. A process according to claim 24 wherein the cellulosic substrate is cotton.

26. A process according to claim 3 wherein the cellulosic substrate is cotton.

27. A process according to claim 10 in which, in step c), fixing is carried bout by the addition of alkali after the substrate has been immersed in the dye-containing liquor for at least 2 minutes.

28. A process according to claim 27 in which an alkali metal tetraborate is added prior to step c).

29. A process according to claim 10 wherein the cellulosic substrate is cotton.

30. An aqueous composition comprising a) 1 to 50% of a dyeing assistant selected from the condensation product of sulphonated diphenyl ethers, the condensation products of sulphonated ditolyl ethers, condensation products of diphenyl sulphones with formaldehyde and condensation products of ditolyl sulphones with formaldehyde;

b) 1 to 50% of an alkali metal tetraborate;

c) 0 to 30% of a solubilizing agent for component b; and d) 0 to 80% water.

31. A composition according to claim 30 selected

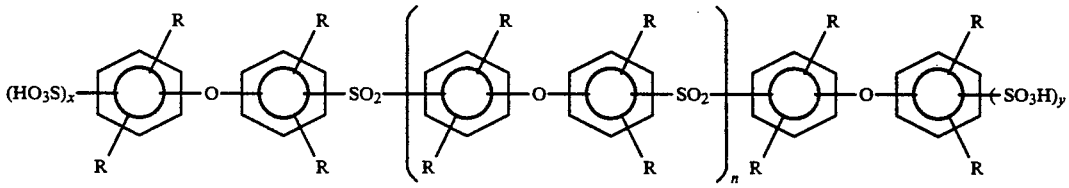

in free acid or salt form, in which x and y, independently, are 0 or 1, provided at least one of x and y is 1;

each R, independently, is selected from hydrogen, methyl and halogen, and from Compositions I to III below:

Composition I 17.6% of a condensation product to sulphonated ditolyl ether, 30.0% of sodium tetraborate.10 $H_2O$ 30.0% of glycerin and
22.4% of water;

Composition II 22.0 parts of a condensation product of sulphonated ditolyl ether
24.0 parts of potassium tetraborate-tetrahydrate

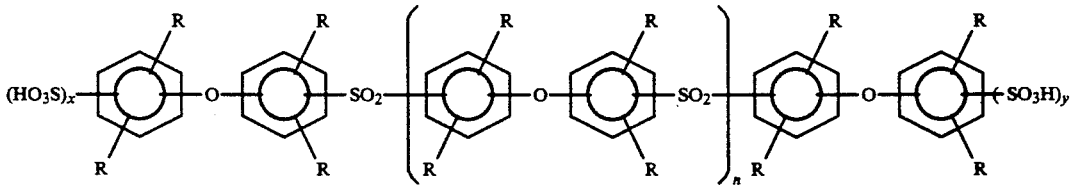

10.0 parts of glycerin
1.5 parts of urea
42.5 parts of water

Composition III is:

40.0 parts of a condensation product of sulphonated ditolyl ether
4.0 parts of borax
2.8 parts of urea
7.8 parts of ammonia sulphate
0.8 parts of polyacrylic acid (molecular weight ca. 5000)
0.8 parts of diethylenetriaminepenta(methylenephosphonic acid)
43.8 parts of water.

32. A composition according to claim 30 containing a complexing agent.

33. A composition according to claim 30 in which the solubilizing agent is selected from carbonyl compounds, alcohols, glycol ethers, esters and heterocyclic compounds.

34. A composition according to claim 32 in which the solubilizing agents are selected from methanol, ethanol, butanol, glycerin, ethylene glycol, diethyene glycol, sorbite, glycerin acetate, monoethylglycol ether, monobutylglycol ether, monoethylglycol ether, monobutyldiglycol ether, butyrolactone and N-methylpyrrolidine.

35. A composition according to claim 30 in which the dyeing assistant is selected from the condensation product of dihydroxydiphenyl sulphone, xylyl sulphonic acid and formaldehyde and compounds of formula I in free acid or salt form, in which x and y, independently, are 0 or 1, provided at least one of x and y is 1;
each R, independently, is selected from hydrogen, methyl and halogen, and
n is 0 or an integer from 1 to 6 inclusive.

36. A composition according to claim 35 in which the compounds of formula I are neutralized with ammonia.

37. A composition according to claim 35 in which the dyeing assistant is a compound of formula I in which R is hydrogen or methyl.

38. A composition according to claim 30 in which any condensation product of sulphonated diphenyl ethers or of sulphonated ditolyl ethers as the dyeing assistant is selected from compounds of formula I

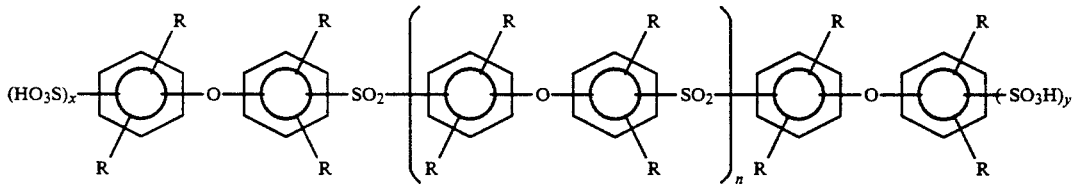

in free acid or salt form, in which x and y, independently, are 0 or 1, provided at least one of x and y is 1;
each R, independently, is selected from hydrogen, methyl and halogen, and
n is 0 or an integer from 1 to 6 inclusive.

39. A natural or synthetic cellulosic containing substrate, which optionally can be mixed with other natural or synthetic fibers, to which a reactive dye has been applied by a process according to claim 1.

* * * * *